US011073033B2

(12) United States Patent
Hall et al.

(10) Patent No.: US 11,073,033 B2
(45) Date of Patent: Jul. 27, 2021

(54) STATOR ATTACHMENT SYSTEM FOR GAS TURBINE ENGINE

(71) Applicant: HONEYWELL INTERNATIONAL INC., Morris Plains, NJ (US)

(72) Inventors: Peter Hall, Prescott, AZ (US); Alan Tiltman, Fountain Hills, AZ (US); Coleen Anne Cramer, Chandler, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 215 days.

(21) Appl. No.: 16/163,866

(22) Filed: Oct. 18, 2018

(65) Prior Publication Data

US 2020/0123919 A1 Apr. 23, 2020

(51) Int. Cl.
*F01D 9/04* (2006.01)

(52) U.S. Cl.
CPC ..... *F01D 9/042* (2013.01); *F05D 2240/12* (2013.01)

(58) Field of Classification Search
CPC ..... F01D 9/042; F01D 25/243; F01D 25/246; F04D 29/4206; F04D 29/284; F04D 29/582; F04D 29/28; F04D 29/42; F04D 29/58; F04D 29/542; F05D 2240/12; F05D 2220/32; F05D 2240/30; F05D 2240/128; F05D 2260/20; F05D 2240/14
USPC ..... 415/209.2
See application file for complete search history.

(56) References Cited

U.S. PATENT DOCUMENTS

| | | | | |
|---|---|---|---|---|
| 2,247,423 | A * | 7/1941 | Webster, Jr. | F01D 25/246 415/209.2 |
| 2,671,634 | A | 3/1954 | Morley | |
| 3,070,353 | A * | 12/1962 | Welsh | F01D 9/042 415/209.2 |
| 3,141,651 | A | 7/1964 | Moyer | |
| 3,302,926 | A * | 2/1967 | Bobo | F01D 9/042 415/209.2 |
| 3,322,331 | A | 5/1967 | Kenny et al. | |
| 3,496,628 | A | 2/1970 | Davis | |
| 4,792,277 | A | 12/1988 | Dittberner, Jr. et al. | |
| 4,834,613 | A | 5/1989 | Hansen et al. | |
| 4,990,056 | A | 2/1991 | McClain et al. | |
| 5,127,797 | A | 7/1992 | Carman | |
| 5,233,822 | A | 8/1993 | Ward et al. | |

(Continued)

FOREIGN PATENT DOCUMENTS

EP 2568126 A2 3/2013

*Primary Examiner* — David Hamaoui
*Assistant Examiner* — Eric A Lange
(74) *Attorney, Agent, or Firm* — Lorenz & Kopf, LLP

(57) ABSTRACT

A stator attachment system couples a stator to a compressor case that is split to define a first half and a second half. The stator attachment system includes a plurality of retention slots defined in each of the first half and the second half of the compressor case. The plurality of retention slots is spaced apart about a perimeter of the first half and the second half such that at least one of the plurality of retention slots associated with the first half is vertically aligned with at least one of the plurality of retention slots associated with the second half. The stator attachment system includes a plurality of tabs defined on the stator that extend radially outward from the stator. Each of the plurality of tabs is configured to engage with one of the plurality of retention slots to couple the stator to the compressor case.

15 Claims, 10 Drawing Sheets

(56) References Cited

U.S. PATENT DOCUMENTS

| | | | | |
|---|---|---|---|---|
| 6,234,750 | B1 | 5/2001 | Mielke et al. | |
| 6,969,239 | B2 | 11/2005 | Grant et al. | |
| 8,206,094 | B2 | 6/2012 | Seki et al. | |
| 8,276,273 | B2 | 10/2012 | Shigemoto et al. | |
| 8,454,308 | B2 | 6/2013 | Itter | |
| 9,441,501 | B2 * | 9/2016 | Ballard, Jr. | F01D 25/26 |
| 2002/0197153 | A1 * | 12/2002 | Rogers | F01D 25/246 415/137 |
| 2010/0080698 | A1 * | 4/2010 | Flanagan | F01D 25/265 415/213.1 |
| 2013/0000324 | A1 * | 1/2013 | Alvanos | F01D 25/246 60/805 |
| 2015/0267561 | A1 | 9/2015 | Huber et al. | |
| 2016/0312800 | A1 * | 10/2016 | Leslie | F04D 29/644 |
| 2017/0335705 | A1 * | 11/2017 | Tyler, Jr. | F01D 11/02 |
| 2017/0363212 | A1 * | 12/2017 | Thoppil | F16J 15/444 |
| 2018/0112546 | A1 * | 4/2018 | Griffin | F04D 29/668 |

* cited by examiner

STATOR ATTACHMENT SYSTEM FOR GAS TURBINE ENGINE

TECHNICAL FIELD

The present disclosure generally relates to gas turbine engines, and more particularly relates to a stator attachment system for a gas turbine engine having a split compressor case.

BACKGROUND

Gas turbine engines may be employed to power various devices. For example, a gas turbine engine may be employed to power a mobile platform, such as an aircraft. Generally, gas turbine engines have a case that surrounds components of the gas turbine engine to protect the engine components and the surroundings. In certain instances, one or more portions of the case may be split into two or more pieces to facilitate the maintenance of the associated components of the gas turbine engine. For example, a case surrounding a compressor section of the gas turbine engine may be split, to enable maintenance of the components associated with the compressor section. The split of the case surrounding the compressor section generally requires that the components associated with the compressor section are able to be coupled to a respective half of the case while maintaining co-axial alignment during operation of the gas turbine engine. In certain instances, in order to couple components associated with the compressor section to the respective half of the case, the compressor component, such as a stator, is split into individual stator pieces, which are individually machined to be received within respective individual pilot bores machined into the case. This increases part count, manufacturing time and assembly time for the gas turbine engine.

Accordingly, it is desirable to provide a stator attachment for a gas turbine engine, which maintains co-axial alignment while reducing part count, manufacturing time and assembly time. Furthermore, other desirable features and characteristics of the present invention will become apparent from the subsequent detailed description and the appended claims, taken in conjunction with the accompanying drawings and the foregoing technical field and background.

SUMMARY

In accordance with various embodiments, provided is a stator attachment system for coupling a stator to a compressor case. The compressor case is split to define a first half and a second half. The stator attachment system includes a plurality of retention slots defined in each of the first half and the second half of the compressor case. The plurality of retention slots is spaced apart about a perimeter of the first half and the second half of the compressor case such that at least one of the plurality of retention slots associated with the first half is vertically aligned with at least one of the plurality of retention slots associated with the second half. The stator attachment system includes a plurality of tabs defined on the stator that extend radially outward from the stator. Each of the plurality of tabs is configured to engage with one of the plurality of retention slots to couple the stator to the compressor case.

Also provided is a gas turbine engine. The gas turbine engine includes a split compressor case having a first half and a second half. Each of the first half and the second half has a plurality of retention slots spaced apart about a perimeter of the respective one of the first half and the second half. The gas turbine engine includes a stator having a plurality of fixed stator vanes. The stator is split to define a first stator half and a second stator half. Each of the first stator half and the second stator half has a plurality of tabs that extend radially outward from the respective one of the first stator half and the second stator half. Each tab of the plurality of tabs is configured to be received within a respective one of the plurality of retention slots to couple the first stator half to the first half of the compressor case and to couple the second stator half to the second half of the compressor case.

Further provided is a gas turbine engine. The gas turbine engine includes a split compressor case having a first half and a second half. Each of the first half and the second half has a plurality of retention slots spaced apart about a perimeter of the respective one of the first half and the second half. The plurality of retention slots includes at least a first retention slot portion at a first end, a second retention slot and a third retention slot portion at a second end. The first end is opposite the second end. The gas turbine engine also includes a stator having a plurality of fixed stator vanes. The stator is split to define a first stator half and a second stator half. Each of the first stator half and the second stator half has a plurality of tabs that extend radially outward from the respective one of the first stator half and the second stator half. Each tab of the plurality of tabs is configured to be received within a respective one of the plurality of retention slots to couple the first stator half to the first half of the compressor case and to couple the second stator half to the second half of the compressor case.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
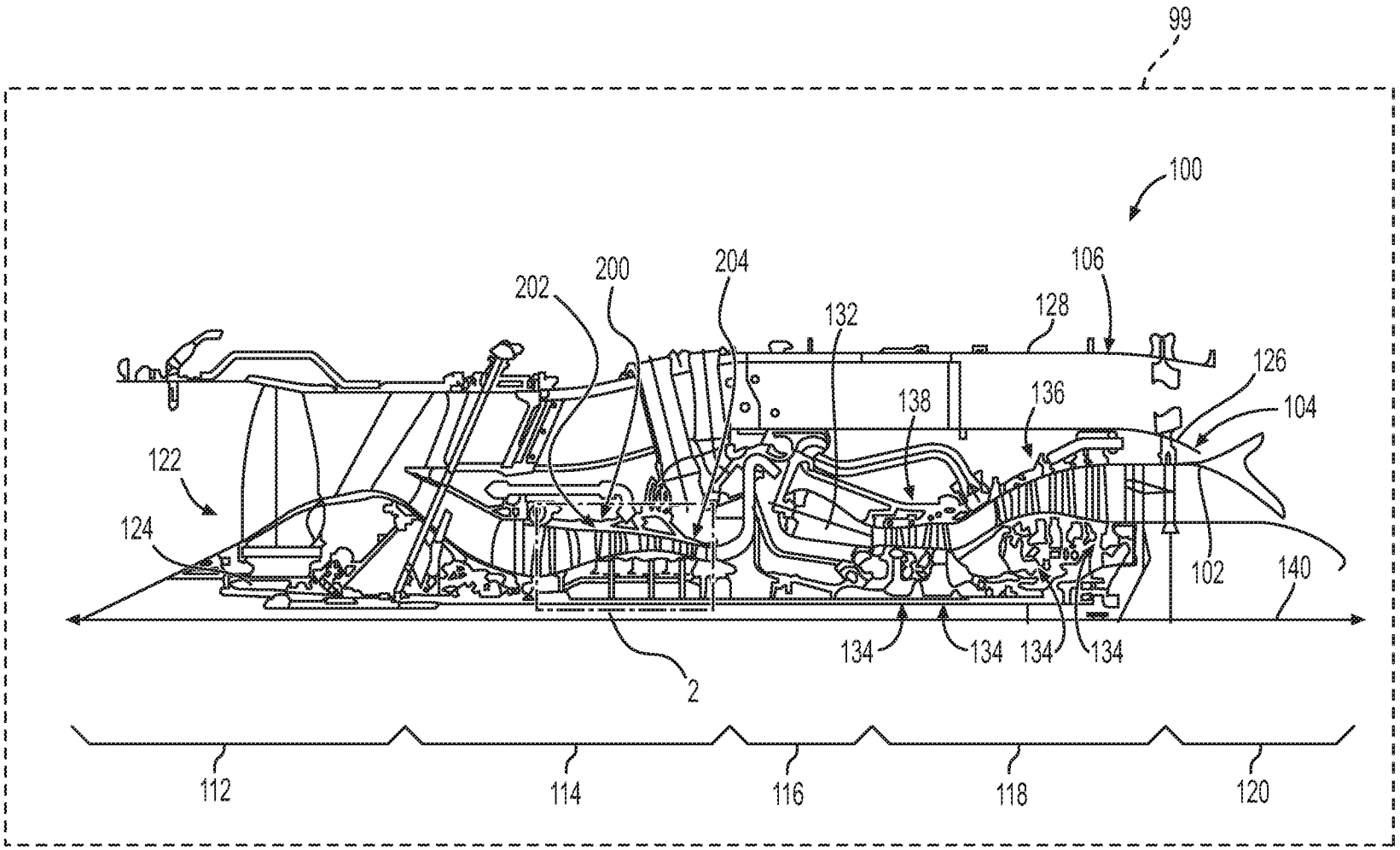
FIG. 1 is a schematic cross-sectional illustration of a gas turbine engine, which includes an exemplary stator attachment system for a gas turbine engine in accordance with the various teachings of the present disclosure.

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of component for use in a gas turbine engine having a split case, and the stator described herein for an axially split compressor case of a compressor section of a gas turbine engine is merely one exemplary embodiment according to the present disclosure. In addition, while the stator attachment is described herein as being used with a stator of a compressor section of a gas turbine engine onboard a mobile platform, such as a bus, motorcycle, train, motor vehicle, marine vessel, aircraft, rotorcraft and the like, the various teachings of the present disclosure can be used with a gas turbine engine on a stationary platform. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally parallel to or coincident with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominately in the respective nominal axial or radial direction. As used herein, the term "transverse" denotes an axis that crosses another axis at an angle such that the axis and the other axis are neither substantially perpendicular nor substantially parallel. Also as used herein, the terms "integrally formed" and "integral" mean one-piece and exclude brazing, fasteners, or the like for maintaining portions thereon in a fixed relationship as a single unit.

With reference to FIG. 1, a partial, cross-sectional view of an exemplary gas turbine engine 100 is shown with the remaining portion of the gas turbine engine 100 being substantially axisymmetric about a longitudinal axis 140, which also comprises an axis of rotation for the gas turbine engine 100. In the depicted embodiment, the gas turbine engine 100 is an annular multi-spool turbofan gas turbine jet engine within an aircraft 99, although other arrangements and uses may be provided. As will be discussed herein, the gas turbine engine 100 includes a stator attachment system 200, which couples two halves of a fixed vane stator 202 to two halves of a compressor case 204 of a compressor section 114 of the gas turbine engine 100. The stator attachment system 200 provides radial and axial piloting for the fixed vane stator 202 to maintain co-axial alignment of the fixed vane stator 202 during operation of the gas turbine engine 100. Further, the stator attachment system 200 reduces leakage in the compressor section 114 by eliminating holes in the case for pilot bores (that would receive individual fixed vane stator pieces). As will be discussed, the stator attachment system 200 also eliminates the need for individual fixed vane stator pieces, as the fixed vane stator 202 may be configured as two half fixed vane stator arrays, which are received within a respective half of the compressor case 204. This reduces part count, manufacturing and assembly time for the gas turbine engine 100.

In this example, with continued reference to FIG. 1, the gas turbine engine 100 includes a fan section 112, the compressor section 114, a combustor section 116, a turbine section 118, and an exhaust section 120. In one example, the fan section 112 includes a fan 122 mounted on a rotor 124 that draws air into the gas turbine engine 100 and accelerates it. A fraction of the accelerated air exhausted from the fan 122 is directed through the outer bypass duct 106 and the remaining fraction of air exhausted from the fan 122 is directed into the compressor section 114. The outer bypass duct 106 is generally defined by an outer casing 128 that is spaced apart from and surrounds the exhaust guide vane 126.

In the embodiment of FIG. 1, the compressor section 114 includes one or more compressors 130. The number of compressors in the compressor section 114 and the configuration thereof may vary. The one or more compressors 130 sequentially raise the pressure of the air and direct a majority of the high pressure air into the combustor section 116. A fraction of the compressed air bypasses the combustor section 116 and is used to cool, among other components, turbine blades in the turbine section 118.

In the embodiment of FIG. 1, in the combustor section 116, which includes a combustion chamber 132, the high pressure air is mixed with fuel, which is combusted. The high-temperature combustion air or combustive gas flow is directed into the turbine section 118. In this example, the turbine section 118 includes one or more turbines 134 disposed in axial flow series. It will be appreciated that the number of turbines, and/or the configurations thereof, may vary. The combustive gas expands through and rotates the turbines 134. The combustive gas flow then exits turbine section 118 for mixture with the cooler bypass airflow from the outer bypass duct 106 and is ultimately discharged from gas turbine engine 100 through exhaust section 120. As the turbines 134 rotate, each drives equipment in the gas turbine engine 100 via concentrically disposed shafts or spools. Generally, the turbines 134 in the turbine section 118, the compressors 130 in the compressor section 114 and the fan 122 are mechanically linked by one or more shafts or spools. For example, in a two spool turbofan engine platform, the turbine rotors contained within a high pressure (HP) turbine stage 136 may be rotationally fixed to the compressors 130 contained within compressor section 114 by a HP shaft, while the turbines 134 contained within a low pressure (LP) turbine stage 138 may be rotationally fixed to the rotor 124 of the fan 122 by a coaxial LP shaft. In other embodiments, gas turbine engine 100 may be a single spool engine or a multi-spool engine containing more than two coaxial shafts.

Figure 2:
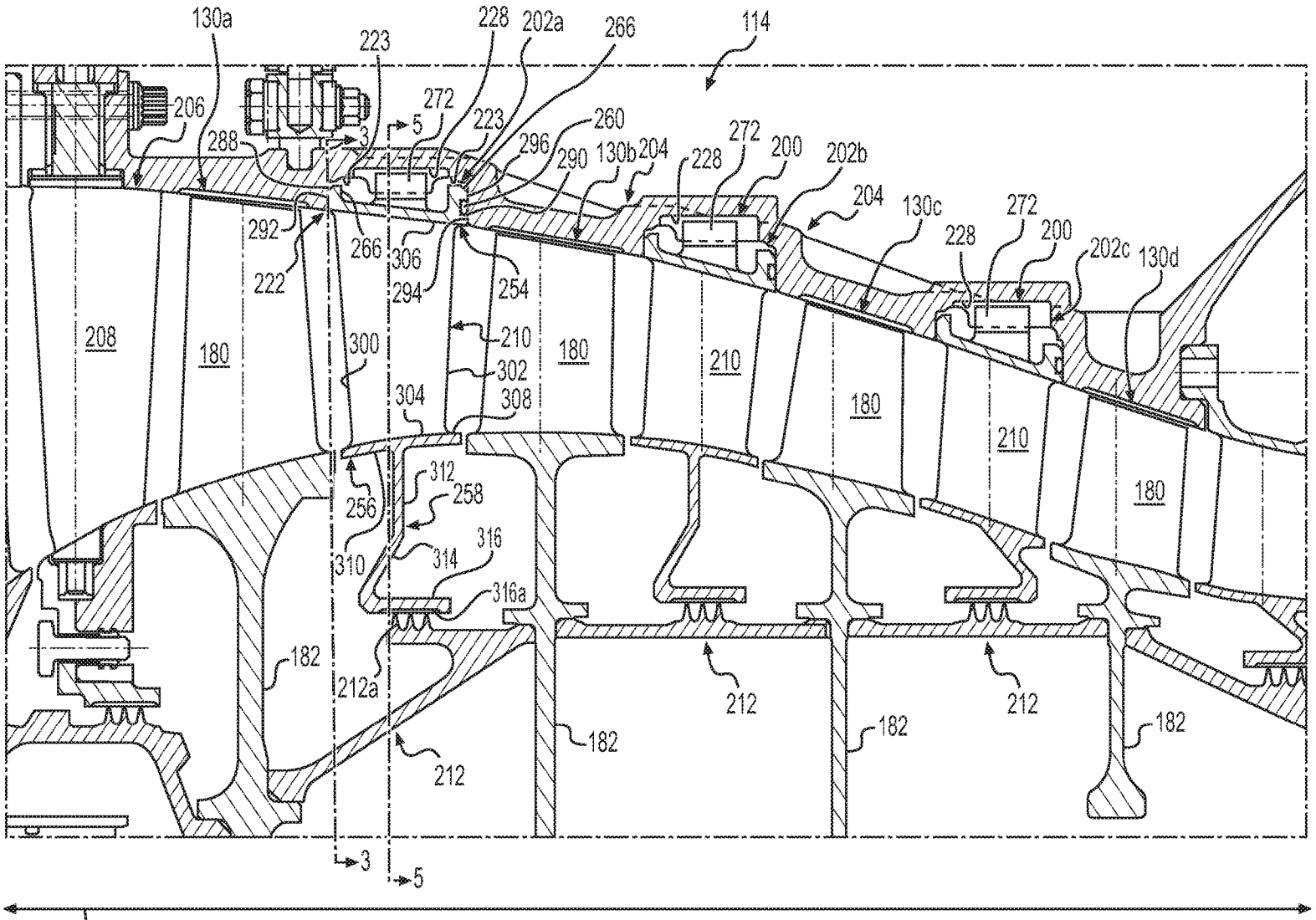
FIG. 2 is a detail cross-sectional view, taken at detail 2 of FIG. 1, which illustrates a compressor section of the gas turbine engine which includes the stator attachment system of FIG. 1 according to various embodiments.

With reference to FIG. 2, a detail view of a portion of the compressor section 114 is shown. In the example of FIG. 2, the compressor section 114 includes four compressors 130*a*-130*d*, which sequentially raise the pressure of the air. Each of the compressors 130*a*-130*d* includes a plurality of airfoils 180, which are coupled to a respective rotor 182. The compressors 130*a*-130*d* are each contained within the compressor case 204, which is axially split along the longitudinal axis 140 (FIG. 1). In this example, the compressor section 114 also includes at least one variable vane stator 206 and at least one fixed vane stator 202. Generally, the variable vane stator 206 includes a plurality of variable stator vanes 208, which are each adjustable or movable relative to the compressor case 204 to direct the airflow through the compressor section 114. In contrast, the fixed vane stator 202 includes a plurality of fixed stator vanes 210 which are unmovable and remain in a fixed or stationary position relative to the compressor case 204. In this example, the compressor section 114 includes three fixed vane stators 202*a*-202*c*; however, the compressor section 114 may include any number of fixed vane stators 202. The compressor section 114 also includes a plurality of sealing structures 212, which reduce air leakage through the compressor section 114. In this example, the stator attachment system 200 couples each of the fixed vane stators 202*a*-202*c* to the compressor case 204, and in this example, each of the fixed vane stators 202*a*-202*c* is substantially the same. As the stator attachment system 200 is the same for each of the fixed vane stators 202*a*-202*c*, the stator attachment system 200 will be discussed herein with regard to the fixed vane stator 202*a* with the understanding that the stator attachment system 200 for each of the fixed vane stators 202*b*, 202*c* is the same.

Figure 3:
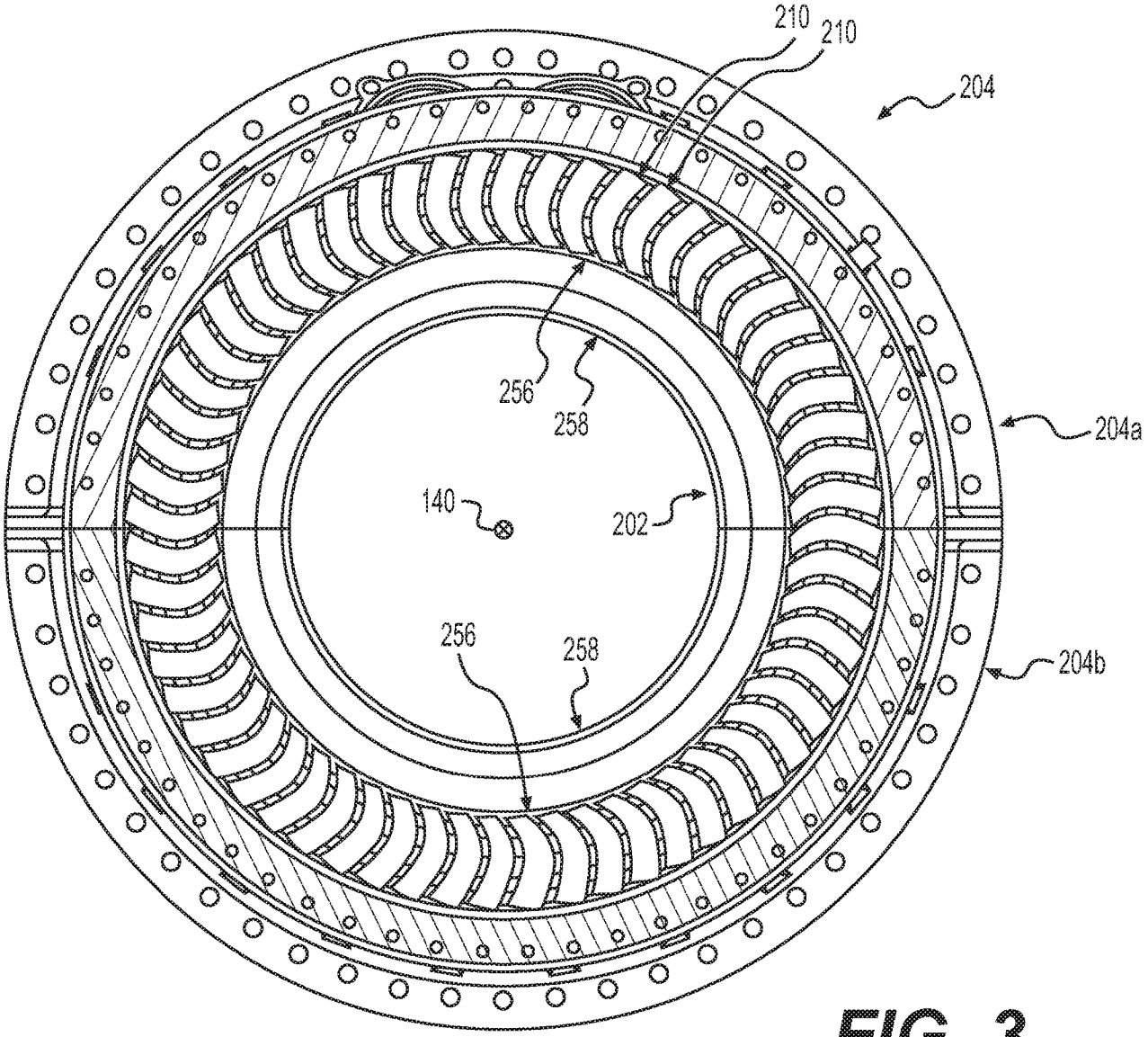
FIG. 3 is a front cross-sectional view of a compressor case surrounding a fixed vane stator, taken from the perspective of line 3-3 in FIG. 2, in which the fixed vane stator is coupled to the compressor case with the stator attachment system and a plurality of sealing structures of the gas turbine engine in FIG. 2 are removed for clarity.

With reference to FIG. 3, the fixed vane stator 202*a* and the compressor case 204 are shown in greater detail. FIG. 3 is a front end view of the compressor case 204 taken from the perspective of line 3-3 of FIG. 2, in which a first half 204*a* of the compressor case 204 is coupled to a second half 204*b* of the compressor case 204. In this example, the compressor case 204 is substantially annular and is symmetric about the longitudinal axis 140 such that the first half 204*a* and the second half 204*b* are symmetric about the longitudinal axis 140. As discussed, in this example, the compressor case 204 is axially split into two halves 204*a*, 204*b*, and each half 204*a*, 204*b* is coupled together via a plurality of mechanical fasteners 218 (FIG. 4), including, but not limited to, bolts, screws, clips, pins, etc. In the example of bolts as the mechanical fastener 218, a nut may be used to secure the halves 204*a*, 204*b* together. Thus, generally, each half 204*a*, 204*b* includes a plurality of fastener bores 220 defined along a mounting flange 219 that extends along a perimeter of the respective half 204*a*, 204*b* to couple the halves 204*a*, 204*b* together. The compressor case 204 is composed of a suitable metal or metal alloy, including, but not limited to titanium, steel or nickel; and are formed by casting, machining, forging, direct metal laser sintering (DMLS), laser powder bed fusion (L-PBF), electron powder bed fusion (E-PBF), electron beam melting (EBM), etc. In one example, with reference to FIG. 4, the compressor case 204 is shown expanded from the fixed vane stator 202*a*. Each half 204*a*, 204*b* of the compressor case 204 includes a plurality of grooves 222 and a plurality of retention slots 225. The grooves 222 each receive a respective one of the fixed vane stators 202. The grooves 222 are each defined within an interior surface 224 of the respective half 204*a*, 204*b* to extend along the interior surface 224 between the mounting flanges 219 in a semi-circular shape. Each of the grooves 222 includes at least one or a pair of channels 223. The pair of channels 223 provides a guide to receive a portion of the fixed vane stator 202 within the groove 222 and provide clearance for a portion of the fixed vane stator 202*a*. In one example, the plurality of retention slots 225 includes a first retention slot portion 226, a second retention slot 228 and a third retention slot portion 230. The first retention slot portion 226, the second retention slot 228 and the third retention slot portion 230 are spaced apart about the perimeter of the groove 222. The channels 223 are interconnected at discrete locations along the respective groove 222 by the first retention slot portion 226, the second retention slot 228 and the third retention slot portion 230. Stated another way, the first retention slot portion 226, the second retention slot 228 and the third retention slot portion 230 are orientated axially or extend along an axis substantially parallel to the longitudinal axis 140 and parallel to a longitudinal axis of the compressor case 204 such that the first retention slot portion 226, the second retention slot 228 and the third retention slot portion 230 interconnect the channels 223 of a respective one of the grooves 222.

Each of the first retention slot portion 226, the second retention slot 228 and the third retention slot portion 230 cooperate with the fixed vane stator 202 to define the stator attachment system 200. In this example, the first retention slot portion 226 is defined on a first end 232 of the respective half 204*a*, 204*b*, and the third retention slot portion 230 is defined on an opposite, second end 234 of the respective half 204*a*, 204*b*. The first retention slot portion 226 and the third retention slot portion 230 are substantially the same, but are defined on opposite ends of the respective half 204*a*, 204*b*. As will be discussed, each of the first retention slot portion 226, the second retention slot 228 and the third retention slot portion 230 are defined into the interior surface 224 so as to extend into the respective half 204*a*, 204*b* to limit axial and radial movement of the fixed vane stator 202. Generally, the plurality of retention slots 225 are defined in each of the first half 204*a* and the second half 204*b* of the compressor case 204 so as to be spaced apart about a perimeter of the first half 204*a* and the second half 204*b* of the compressor case 204. In one example, at least one of the plurality of retention slots 225 associated with the first half 204*a* is vertically aligned with at least one of the plurality of retention slots 225 of the second half 204*b*. In this example, the second retention slot 228 of each of the first half 204*a* and the second half 204*b* is vertically aligned along a vertical axis VA (FIG. 5).

Figure 5:
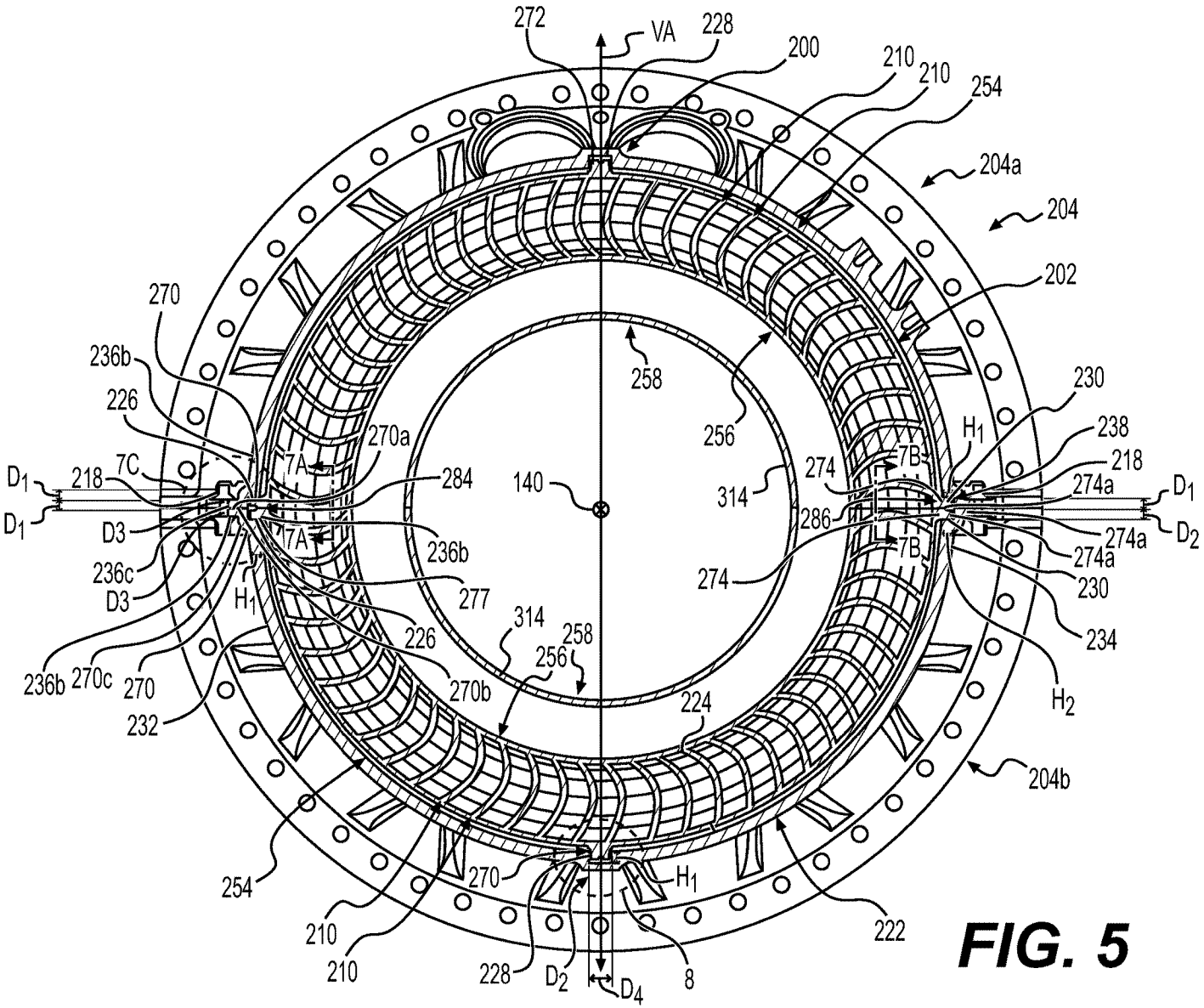
FIG. 5 is a front cross-sectional view of the compressor case surrounding the fixed vane stator, taken from the perspective of line 5-5 in FIG. 2, which illustrates the stator attachment system for coupling the fixed vane stator to the compressor case and the plurality of sealing structures of the gas turbine engine in FIG. 2 are removed for clarity.

With reference to FIG. 5, the first retention slot portion 226 and the third retention slot portion 230 each extend for a distance D1, which is less than a distance D2 of the second retention slot 228. The first retention slot portion 226 and the third retention slot portion 230 of the half 204*a* cooperate with the first retention slot portion 226 and the third retention slot portion 230 of the half 204*b* when the compressor case 204 is assembled to define a respective assembled retention slot 236, 238. The assembled retention slots 236, 238 extend for a combined distance (D1+D1), which is substantially equal to D2. It should be noted that in other embodiments, the distances may or may not be equal.

Figure 4:
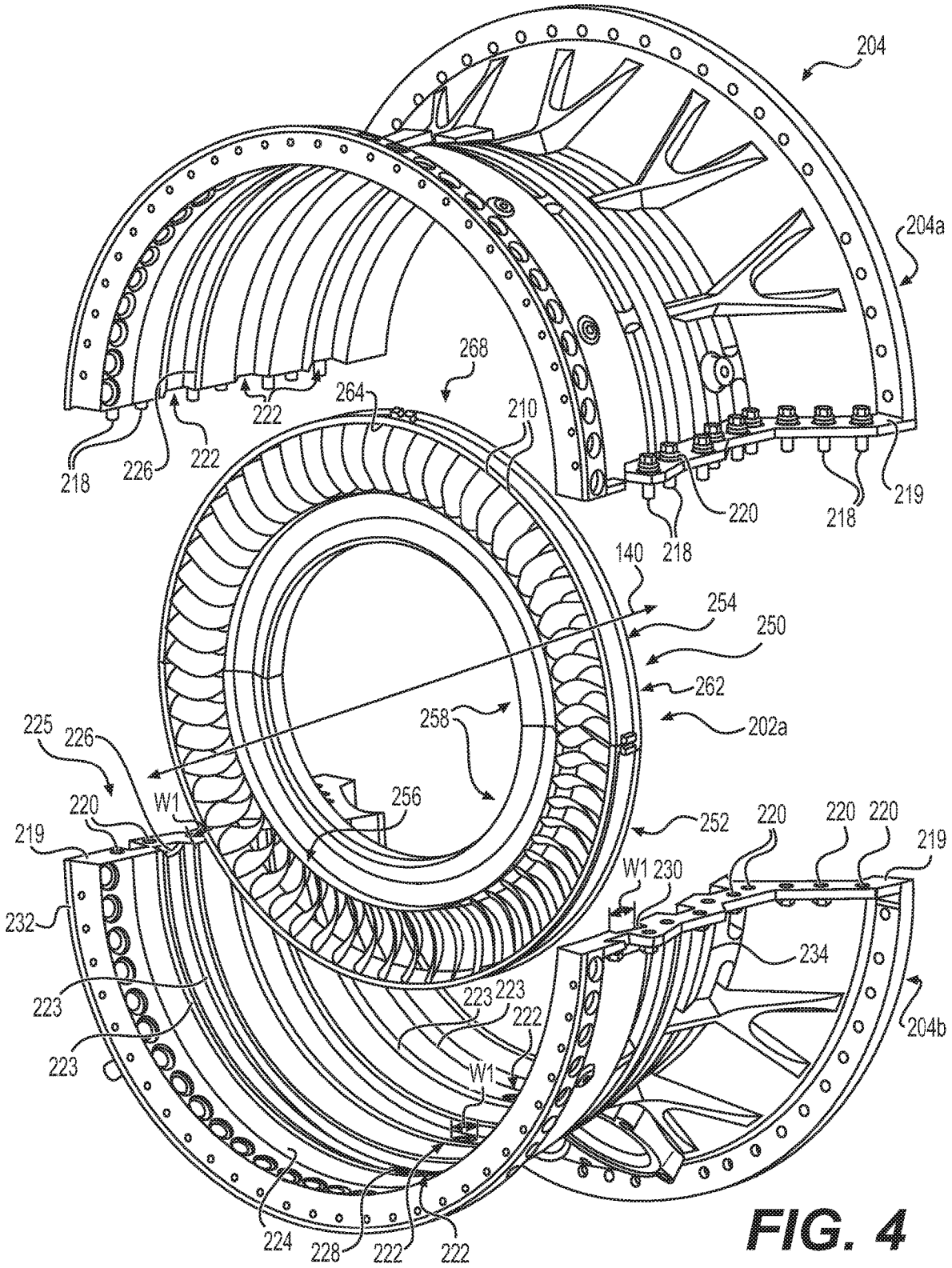
FIG. 4 is a perspective view of the compressor case and the fixed vane stator in which the compressor case is expanded from the fixed vane stator and the plurality of sealing structures of the gas turbine engine in FIG. 2 are removed for clarity.

The second retention slot 228 is defined between the first retention slot portion 226 and the third retention slot portion 230. Generally, the second retention slot 228 of the half 204*a* is defined so as to be opposite the second retention slot 228 of the half 204*b*, and thus, the second retention slot 228 of the half 204*a* may be considered a retention slot for a top side of the compressor case 204 and the second retention slot 228 of the half 204*b* may be considered a retention slot for an opposite bottom side of the compressor case 204. Each of the first retention slot portion 226, the second retention slot 228 and the third retention slot portion 230 also have a depth H1, which is substantially equal for each of the first retention slot portion 226, the second retention slot 228 and the third retention slot portion 230. With reference to FIG. 4, each of the first retention slot portion 226, the second retention slot 228 and the third retention slot portion 230 have a width W1, which is substantially equal to a width of the respective groove 222. As will be discussed, the width W1, the depth H1 (FIG. 5) and the distances D1, D2 (FIG. 5) are sized to cooperate with corresponding features of the fixed vane stator 202 to retain the fixed vane stator 202 within the respective half 204*a*, 204*b* of the compressor case 204.

Figure 6:
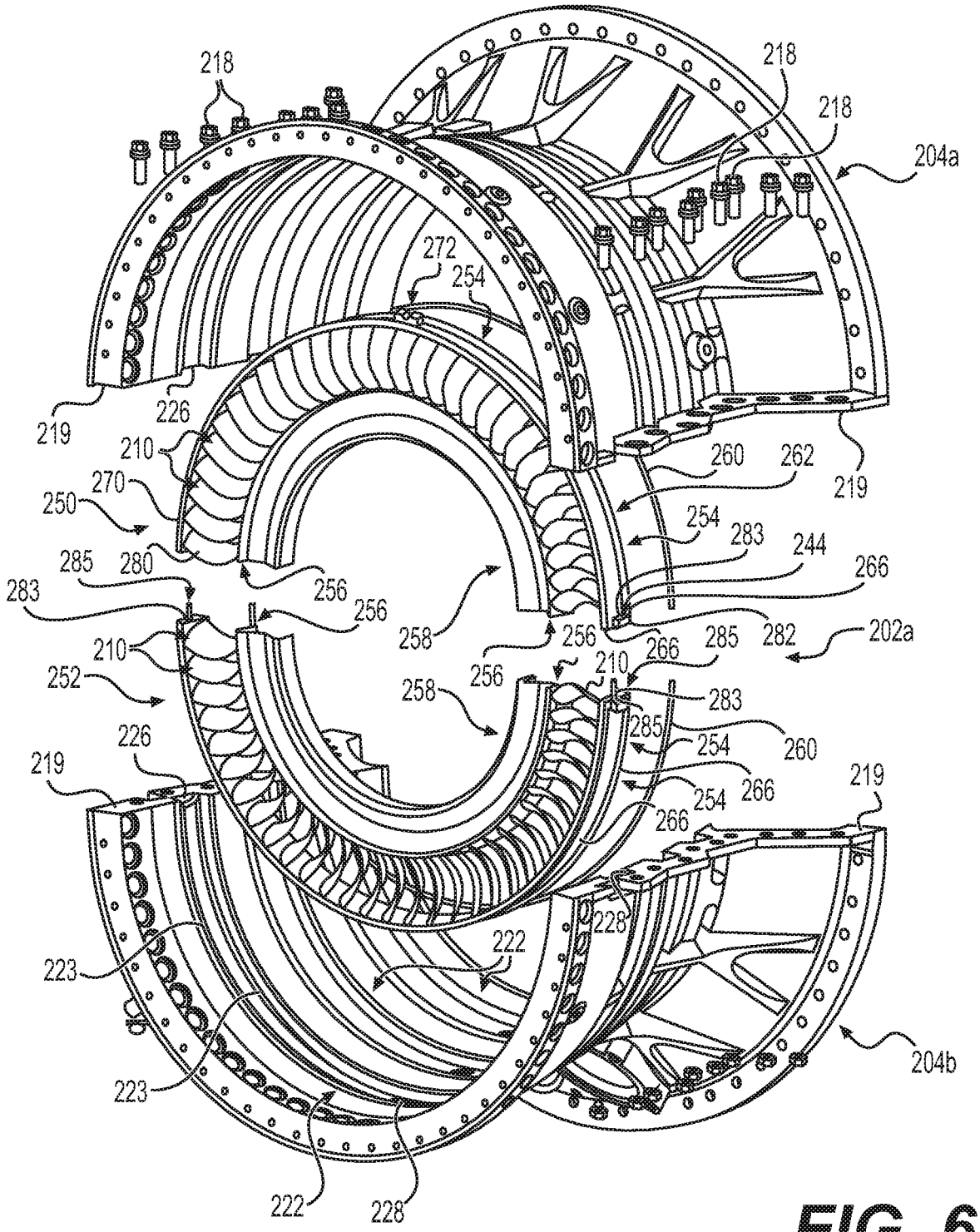
FIG. 6 is a perspective exploded view of the compressor case and the fixed vane stator and the plurality of sealing structures of the gas turbine engine in FIG. 2 are removed for clarity.

With reference to FIG. 4, the fixed vane stator 202*a* includes a first stator half 250 and a second stator half 252, which are shown coupled together. The first stator half 250 and the second stator half 252 cooperate to guide air through the compressor section 114 (FIG. 2) and are symmetric about the longitudinal axis 140 (FIG. 5). Each of the first stator half 250 and the second stator half 252 include a first, outer platform 254, the plurality of fixed stator vanes 210, a second, inner platform 256, an inner seal interface 258 and an optional sealing member 260 (FIG. 6). In one example, each of the first stator half 250 and the second stator half 252 are integrally formed such that the respective outer platform 254, the plurality of fixed stator vanes 210, the inner platform 256 and the inner seal interface 258 are monolithic or one-piece. It should be noted that in other embodiments, one or more of the outer platform 254, the plurality of fixed stator vanes 210, the inner platform 256 and the inner seal interface 258 may be discrete components that are coupled together though a suitable technique, such as a bonding, mechanical fasteners, etc. In this example, each of the first stator half 250 and the second stator half 252 are formed from a metal or metal alloy, including, but not limited to nickel, steel or titanium; and are formed through casting, machining, forging, direct metal laser sintering (DMLS), laser powder bed fusion (L-PBF), electron powder bed fusion (E-PBF), electron beam melting (EBM), etc. By providing the outer platform 254, the plurality of fixed stator vanes 210, the inner platform 256 and the inner seal interface 258 as one-piece, the part count and complexity of the fixed vane stator 202*a* is reduced. Moreover, by providing the plurality of fixed stator vanes 210, an array of about 180 degrees of fixed stator vanes 210 may be coupled to the respective half 204*a*, 204*b* of the compressor case 204, which also reduces part count, manufacturing and assembly time for the gas turbine engine 100.

With continued reference to FIG. 6, the outer platform 254 is annular and semi-circular. The outer platform 254 defines an outer perimeter of the respective one of the first stator half 250 and the second stator half 252. In one example, the outer platform 254 includes a first side 262 opposite a second side 264. The first side 262 is coupled to the compressor case 204, and the second side 264 is coupled to or integrally formed with the plurality of fixed stator vanes 210. The first side 262 includes at least one or a pair of rails 266 and a plurality of tabs 268. The rails 266 extend radially outward from the first side 262, and are spaced apart axially on the first side 262. The pair of rails 266 are each sized and shaped to be received within a respective one of the pair of channels 223 of a respective one of the grooves 222 so as to be spaced a distance apart from the respective one of the pair of channels 223 (FIG. 2) to allow for thermal expansion during operation of the gas turbine engine 100 (FIG. 1). The plurality of tabs 268 cooperate with the plurality of retention slots 225 to form the stator attachment system 200. Stated another way, the stator attachment system 200 includes the plurality of retention slots 225 and the plurality of tabs 268, and each of the plurality of retention slots 225 receive a respective one of a plurality of the tabs 268 to couple the first stator half 250 and the second stator half 252 to the respective half 204*a*, 204*b* of the compressor case 204. Thus, in this example, the first stator half 250 and the second stator half 252 each include the plurality of tabs 268, which engage a respective one of the plurality of retention slots 225 to couple the fixed vane stator 202*a* to the compressor case 204.

Figure 7A:
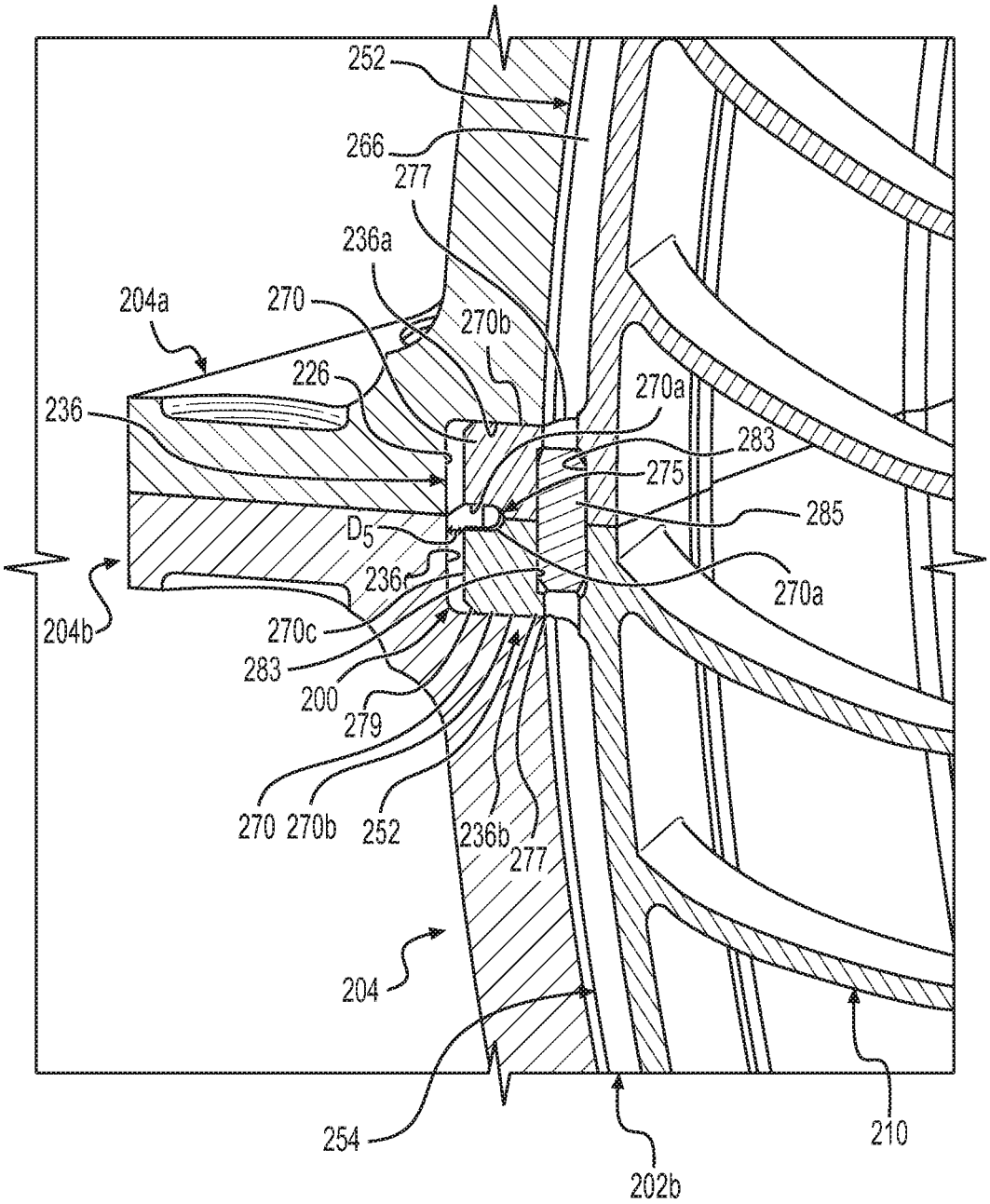
FIG. 7A is a cross-sectional detail view of a portion of the stator attachment system, taken from the perspective of line 7A-7A in FIG. 5, which illustrates a pin that couples a first half of the fixed vane stator to a second half of the fixed vane stator.
Figure 7B:
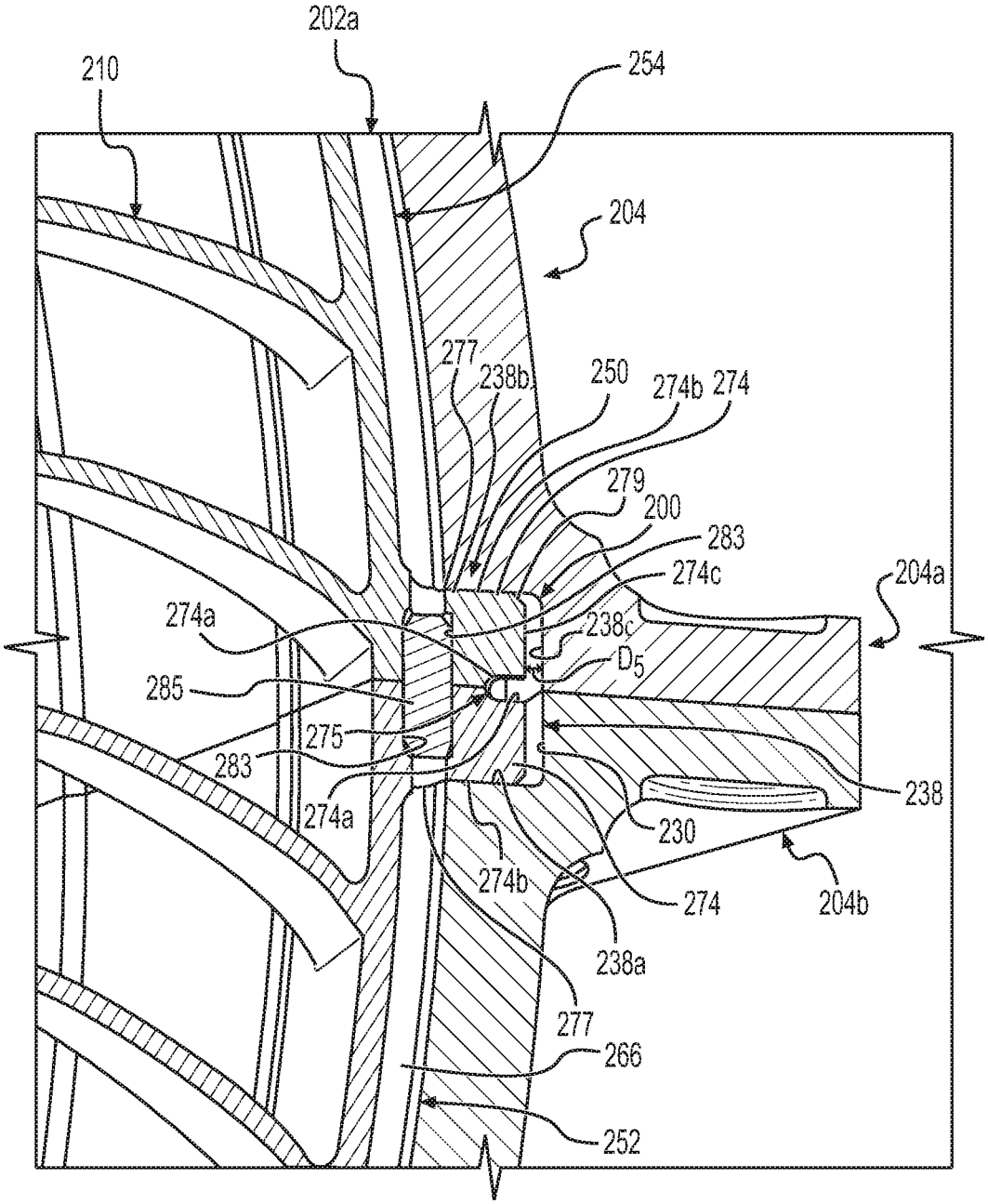
FIG. 7B is a cross-sectional detail view of a portion of the stator attachment system opposite the portion of the stator attachment system of FIG. 7A, taken from the perspective of line 7B-7B in FIG. 5, which illustrates a pin that couples a first half of the fixed vane stator to a second half of the fixed vane stator.

In this example, the plurality of tabs 268 includes a first tab portion 270, a second tab 272 and a third tab portion 274. Each of the first tab portion 270, the second tab 272 and the third tab portion 274 extend radially outward from the first side 262 and are spaced apart from each other about a perimeter of the first side 262. Each of the first tab portion 270, the second tab 272 and the third tab portion 274 are substantially rectangular, however, the first tab portion 270, the second tab 272 and the third tab portion 274 may have any shape that cooperates with the respective one of the retention slots 225 to restrict the movement of the respective one of the first stator half 250 and the second stator half 252. The first tab portion 270 is defined at a first end 280 of the outer platform 254, and the third tab portion 274 is defined at a second end 282 of the outer platform 254, with the second end 282 opposite the first end 280. The first tab portion 270 and the third tab portion 274 are substantially the same, but are defined on opposite ends 280, 282 of the respective stator half 250, 252. Each of the first tab portion 270 and the third tab portion 274 define a coupling bore 283. The coupling bore 283 of the first tab portion 270 of the first stator half 250 is coaxially aligned with the coupling bore 283 of the first tab portion 270 of the second stator half 252 when the fixed vane stator 202*a* is assembled to enable a mechanical fastener, including, but not limited to a pin 285 to be received within each of the coupling bores 283 to couple the first tab portion 270 of the first stator half 250 to the first tab portion 270 of the second stator half 252, as shown in FIG. 7A. Similarly, the coupling bore 283 of the third tab portion 274 of the first stator half 250 is coaxially aligned with the coupling bore 283 of the third tab portion 274 of the second stator half 252 when the fixed vane stator 202*a* is assembled to enable the pin 285 to be received within each of the coupling bores 283 to couple the third tab portion 274 of the first stator half 250 to third tab portion 274 of the second stator half 252 as shown in FIG. 7B. It should be noted that the pins 285 may be integrally formed with a respective one of the coupling bores 283 of the first stator half 250 or the second stator half 252 during the formation of the first stator half 250 or the second stator half 252 to further reduce the assembly time of the gas turbine engine 100 by eliminating the insertion of the pins 285 during assembly.

Figure 7C:
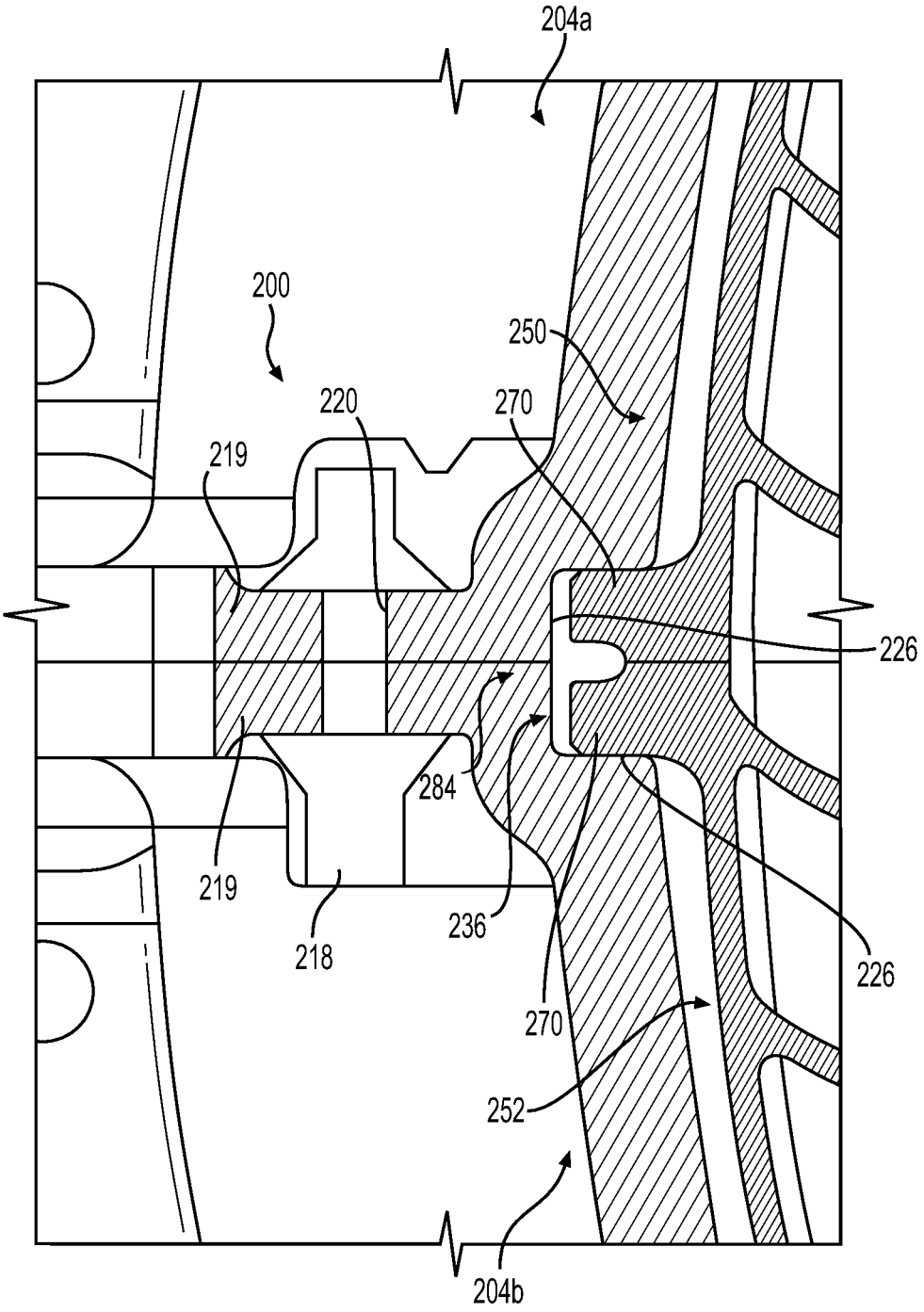
FIG. 7C is a detail cross-sectional view of a portion of the stator attachment system, taken at detail 7C of FIG. 5, which illustrates respective first tab portions engaged with respective retention slot portions.

With reference to FIG. 5, the first tab portion 270 and the third tab portion 274 each extend for a distance D3, which is less than a distance D4 of the second tab 272. The first tab portion 270 and the third tab portion 274 of the first stator half 250 cooperate with the first tab portion 270 and the third tab portion 274 of the second stator half 252 when the fixed vane stator 202 is assembled to the compressor case 204 to define a respective assembled tab 284, 286. The assembled tab 284 is shown in FIG. 7C, with the understanding that the assembled tab 286 is a mirror image of the assembled tab 284 as shown in FIG. 5. The assembled tabs 284, 286 extend for a combined distance (D3+D3), which is substantially equal to D4. It should be noted that in other embodiments, the distances may or may not be equal. Generally, the distance D3 is slightly less than the distance D1 so that the first tab portion 270 and the third tab portion 274 may be positioned within the first retention slot portion 226 and the third retention slot portion 230. Similarly, the distance D4 is slightly less than the distance D2 so that the second tab 272 may be positioned within the second retention slot 228.

The second tab 272 is defined between the first tab portion 270 and the third tab portion 274. Generally, the second tab 272 of the first stator half 250 is defined so as to be opposite the second tab 272 of the second stator half 252, and thus, the second tab 272 of the first stator half 250 may be considered a tab for a top side of the fixed vane stator 202*a* and the second tab 272 of the second stator half 252 may be considered a tab for an opposite bottom side of the fixed vane stator 202*a*. Each of the first tab portion 270, the second tab 272 and the third tab portion 274 also have a height H2, which is substantially equal for each of the first tab portion 270, the second tab 272 and the third tab portion 274. The height H2 is slightly greater than the depth H1 associated with the plurality of retention slots 225 so that the first tab portion 270, the second tab 272 and the third tab portion 274 may extend radially into the respective one of the plurality of retention slots 225.

With reference to FIG. 4, each of the first tab portion 270, the second tab 272 and the third tab portion 274 have a width W2. The width W2 is slightly less than the width W1 associated with the plurality of retention slots 225 so that the first tab portion 270, the second tab 272 and the third tab portion 274 may be received within the respective one of the plurality of retention slots 225. Thus, the first tab portion 270, the second tab 272 and the third tab portion 274 of each of the first stator half 250 and the second stator half 252 cooperate with the first retention slot portion 226, the second retention slot 228 and the third retention slot portion 230 of the respective one of the halves 204*a*, 204*b* of the compressor case 204 to attach the fixed vane stator 202*a* to the compressor case 204 while providing axial and radial piloting during the operation of the gas turbine engine 100 (FIG. 1).

Figure 8:
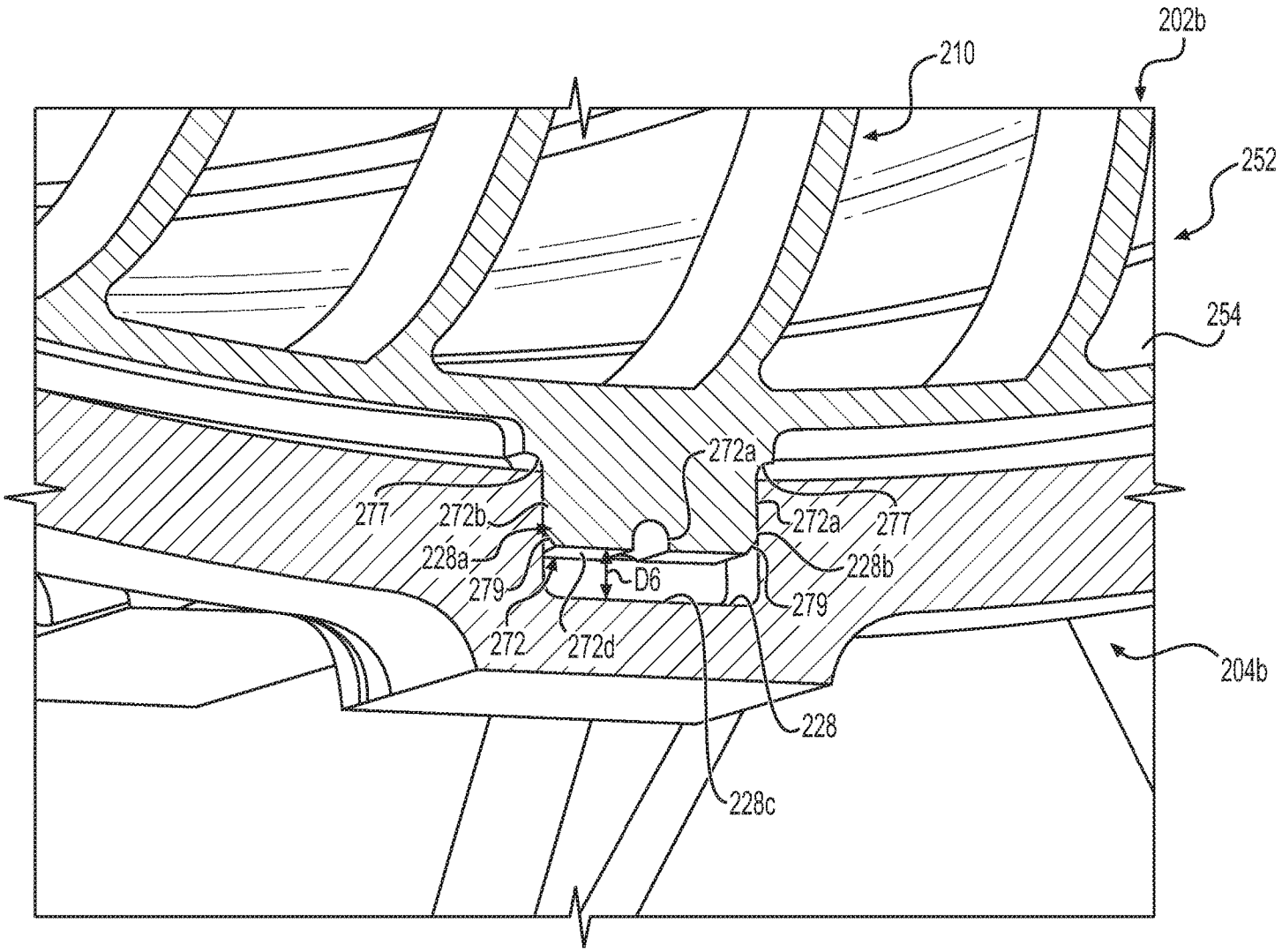
FIG. 8 is a detail cross-sectional view of a portion of the stator attachment system, taken at detail 8 of FIG. 5, which illustrates a tab engaged with a retention slot.

In one example, with reference to FIG. 5, each of the first tab portion 270 and the third tab portion 274 include a notch 270*a*, 274*a*. With reference to FIG. 7A, a detail cross-sectional view of the first tab portion 270 of the first stator half 250 and the second stator half 252 is shown. FIG. 7B is a detail cross-sectional view of the third tab portion 274 of the first stator half 250 and the second stator half 252. As shown, the notches 270*a* (FIG. 7A) and the notches 274*a* (FIG. 7B) cooperate to define a recess 275. The recess 275 is sized and shaped to receive a tool, including, but not limited to a flat head screwdriver, to enable the separation of the first stator half 250 from the second stator half 252. Stated another way, the notches 270*a*, 274*a* enable a tool, such as a flat head screwdriver, to be positioned between the first tab portions 270 and the third tab portions 274 to separate the first stator half 250 from the second stator half 252 when the first stator half 250 is coupled or assembled to the second stator half 252 with the pins 285. With reference to FIG. 8, in one example, the second tab 272 also defines a notch 272*a*. The notch 272*a* provides a datum for manufacturing the respective one of the first stator half 250 and the second stator half 252. It should be noted that while the first tab portion 270, the second tab 272 and the third tab portion 274 are illustrated and described herein as including the respective notches 270*a*, 272*a*, 274*a*, one or more of the first tab portion 270, the second tab 272 and the third tab portion 274 may not include the respective notch 270*a*, 272*a*, 274*a*.

In addition, with reference to FIGS. 7A and 7B, in one example, the first tab portion 270 and the third tab portion 274 include a fillet 277. The fillet 277 is defined along a sidewall 270*b*, 274*b* of the first tab portion 270 (FIG. 7A) and the third tab portion 274 (FIG. 7B), respectively, near the respective transition between the outer platform 254 and the first tab portion 270 and the third tab portion 274. The first tab portion 270 and the third tab portion 274 may also include a chamfer 279 at a transition between the sidewall 270*b*, 274*b* and a sidewall 270*c* (FIG. 7A), 274*c* (FIG. 7B) that defines the terminal end of the first tab portion 270 and the third tab portion 274.

With reference to FIG. 8, in one example, the second tab 272 includes a pair of the fillets 277. The fillets 277 are defined along a sidewall 272*b*, 272*c* of the second tab 272 near the respective transition between the outer platform 254 and the second tab 272. The second tab 272 may also include a pair of the chamfers 279 at a transition between the sidewall 272*b*, 272*c* and a sidewall 272*d* that defines the terminal end of the second tab 272. It should be noted that while the first tab portion 270, the second tab 272 and the third tab portion 274 are illustrated and described herein as including the respective fillets 277 and chamfers 279, one or more of the first tab portion 270, the second tab 272 and the third tab portion 274 may not include the respective fillets 277 and chamfers 279.

With reference to FIG. 2, the outer platform 254 also includes a first, front surface 288 and an opposite second, back surface 290. The rails 266 each extend radially from the first side 262 of the outer platform 254 at a respective one of the front surface 288 and the back surface 290. The front surface 288 contacts a first sidewall 292 of the groove 222, and the back surface 290 contacts a second sidewall 294 of the groove 222. In this example, the back surface 290 defines an annular slot 296, which receives the sealing member 260 to reduce air leakage about the fixed vane stator 202*a*.

The fixed vane stator 202*a* also includes the plurality of fixed stator vanes 210. Each of the fixed stator vanes 210 includes a leading edge 300 opposite a trailing edge 302, and a root 304 opposite a tip 306. Each of the fixed stator vanes 210 directs the airflow through the compressor section 114 and is static, stationary or fixed in orientation. The tip 306 is coupled to or integrally formed with the outer platform 254, and the root 304 is coupled to or integrally formed with the inner platform 256.

The inner platform 256 is defined between the plurality of fixed stator vanes 210 and the inner seal interface 258. The inner platform 256 is annular and semi-circular. In one example, the inner platform 256 includes a third side 308 opposite a fourth side 310. The third side 308 is coupled to or integrally formed with the root 304 of each of the fixed stator vanes 210, and the fourth side 310 is coupled to or integrally formed with the inner seal interface 258.

The inner seal interface 258 includes a first leg 312, a second leg 314 and a third leg 316. The first leg 312 is coupled to or integrally formed with the inner platform 256, and the second leg 314. The second leg 314 is coupled to or integrally formed with the first leg 312 and the third leg 316. The second leg 314 extends along an axis, which is substantially oblique to the longitudinal axis 140. It should be noted that the second leg 314 may extend along the axis to define a positive or negative angle with the longitudinal axis 140 depending upon the position of the fixed vane stator 202 in the compressor section 114. In the example of the fixed vane stator 202*a*, the second leg 314 extends at a positive angle relative to the longitudinal axis 140, and in the example of the fixed vane stator 202*c*, the second leg 314 extends at a negative angle relative to the longitudinal axis 140. The third leg 316 is coupled to the sealing structure 212. In one example, the third leg 316 defines a recess 316*a*, which receives a portion of the sealing structure 212, such as a portion of a labyrinth seal 212*a*. The third leg 316 cooperates with the labyrinth seal 212*a* to reduce leakage through the compressor section 114. The third leg 316 also defines an inner perimeter or circumference of the respective one of the first stator half 250 and the second stator half 252. It should be noted that while the inner seal interface 258 is illustrated and described herein as being monolithic with the inner platform 256, it should be understood that the inner seal interface 258 may be discrete from the inner platform 256 and coupled to the inner platform 256 via a suitable technique, including, but not limited to, a plurality of mechanical fasteners disposed in bores defined along the perimeter of both the inner seal interface 258 and the inner platform 256.

The sealing member 260 is received within and coupled to the slot 296. In one example, with reference to FIG. 6, the sealing member 260 is an elastomeric ring, such as an semi-circular O-ring, which is received within the slot 296. With reference back to FIG. 2, the sealing member 260 cooperates with the groove 222 to reduce leakage and recirculation within the compressor section 114. The sealing member 260 also pre-loads the fixed vane stator 202*a* within the compressor case 204. It should be noted that the sealing member 260 may be optional.

In order to assemble the fixed vane stator 202*a* into the compressor case 204, with reference to FIG. 6, in one example, with the second stator half 252 formed, the sealing member 260 is inserted into the slot 296 of the outer platform 254. With the second half 204*b* of the compressor case 204 formed with the respective grooves 222 and the plurality of retention slots 225, and the second stator half 252 formed with the plurality of tabs 268, the outer platform 254 is positioned within the groove 222 such that the rails 266 are received within the channels 223 of the groove 222. The first tab portion 270 is received within the first retention slot portion 226, the second tab 272 is received within the second retention slot 228, and the third tab portion 274 is received within the third retention slot portion 230. With the second stator half 252 coupled to the half 204*b* and the first stator half 250 formed, the sealing member 260 is inserted into the slot 296 of the outer platform 254 of the first stator half 250. The pins 285 are positioned within the coupling bores 283 to couple the first stator half 250 to the second stator half 252. It should be noted that in other embodiments, the pins 285 may be integrally formed with the first stator half 250 or the second stator half 252 to reduce assembly time, if desired. This process may be repeated for each of the fixed vane stators 202*b*, 202*c*. With the first half 204*a* of the compressor case 204 formed with the respective grooves 222 and the plurality of retention slots 225, the first half 204*a* is positioned over the first stator half 250 such that the outer platform 254 of the first stator half 250 is positioned within the groove 222 and the rails 266 are received within the channels 223 of the groove 222. The first tab portion 270 is received within the first retention slot portion 226, the second tab 272 is received within the second retention slot 228, and the third tab portion 274 is received within the third retention slot portion 230. This process may be repeated for each of the fixed vane stators 202*b*, 202*c*. With the first stator half 250 coupled to the second stator half 252 for each of the fixed vane stators 202*a*-202*c*, the mechanical fasteners 218 may be inserted through the fastener bores 220 of the mounting flange 219 to couple the first half 204*a* to the second half 204*b* of the compressor case 204.

With reference to FIGS. 7A and 7B, the planar or flat sidewalls 270*b* (FIG. 7A), 274*b* (FIG. 7B) of the first tab portion 270 and the third tab portion 274, respectively, cooperate with planar or flat sidewalls 236*a*, 236*b*; 238*a*, 238*b* of the assembled retention slots 236, 238, respectively, to limit or constrain movement of the fixed vane stator 202*a*-202*c* radially and axially (relative to the longitudinal axis 140 (FIG. 5)). In addition, generally, the planar or flat sidewalls 270*c* (FIG. 7A), 274*c* (FIG. 7B) are spaced apart from a planar or flat sidewall 238*c* by a distance D5, which provides clearance for thermal expansion of the fixed vane stator 202*a*-202*c* and/or the compressor case 204. Similarly, with reference to FIG. 8, planar or flat sidewalls 272*b*, 272*c* of the second tab 272 cooperate with planar or flat sidewalls 228*a*, 228*b* of the second retention slot 228 to limit or constrain movement of the fixed vane stator 202*a*-202*c* radially and axially (relative to the longitudinal axis 140 (FIG. 5)). In addition, generally, the sidewall 272*d* is spaced apart from a planar or flat sidewall 228*c* by a distance D6, which provides clearance for thermal expansion of the fixed vane stator 202*a*-202*c* and/or the compressor case 204. The distance D6 may also serve to limit local radial displacement of the fixed vane stator 202*a*-202*c* perpendicular to a plane that defines the split plane for the compressor case 204 in order to maintain the roundness of the fixed vane stator 202*a*-202*c* and the inner seal interface 258.

Thus, the stator attachment system 200 provides for improved attachment of the fixed vane stators 202*a*-202*c* to an axially split compressor case 204 through the use of the plurality of tabs 268 that each engage a respective one of a plurality of retention slots 225. By providing the plurality of tabs 268 integrally formed with the fixed vane stator 202, additional mechanical fasteners are not required to couple the fixed vane stators 202*a*-202*c* to the compressor case 204, which reduces a number of bores that may need to be formed in the compressor case 204. Moreover, by positioning the plurality of tabs 268 to be spaced apart by about 90 degrees (the first tab portion 270 of the first stator half 250 at about 0 degrees, the second tab 272 of the first stator half 250 at about 90 degrees, the third tab portion 274 of the first stator half 250 at about 180 degrees, the third tab portion 274 of the second stator half 252 at 180 degrees, the second tab 272 of the second stator half 252 at about 270 degrees, and the first tab portion 270 of the second stator half 252 at about 360 or 0 degrees) about a circumference of the fixed vane stators 202*a*-202*c* (when assembled as shown in FIG. 5) and the plurality of retention slots 225 to be spaced apart by about 90 degrees (the first retention slot portion 226 of the first half 204*a* at about 0 degrees, the second retention slot 228 of the first half 204*a* at about 90 degrees, the third retention slot portion 230 of the first half 204*a* at about 180 degrees, the third retention slot portion 230 of the second half 204*b* at 180 degrees, the second retention slot 228 of the second half 204*b* at about 270 degrees, and the first retention slot portion 226 of the second half 204*b* at about 360 or 0 degrees) about a circumference of the compressor case 204 (FIG. 5), the stator attachment system 200 provides radial and axial piloting for the respective fixed vane stator 202*a*-202*c* and maintains the respective fixed vane stator 202*a*-202*c* co-axially aligned with the compressor case 204 during operation of the gas turbine engine 100. Generally, the stator attachment system 200 includes two of the plurality of tabs 268 along the plane that defines the split plane for the compressor case 204, which in this example comprise the assembled tabs 284, 286. The stator attachment system 200 also includes two of the plurality of tabs 268 perpendicular to the plane that defines the split plane for the compressor case 204, which in this example, comprise the second tab 272 of each of the first stator half 250 and the second stator half 252. Thus, in this example, the plurality of tabs 268 are substantially coincident with and aligned 90 degrees with the split plane for the compressor case 204. This arrangement of the plurality of tabs 268, which cooperate with the similarly arranged plurality of retention slots 225, provides for the radial and axial piloting of each of the fixed vane stators 202*a*-202*c*. Further, the stator attachment system 200 enables the first stator half 250 and the second stator half 252 to include about 180 degrees of the fixed stator vanes 210, which reduces assembly time and part count for the gas turbine engine 100. It should also be noted that the stator attachment system 200 enables the fixed vane stators 202 to be composed of a material having a coefficient of thermal expansion, which is different than the coefficient of thermal expansion of the material from which the compressor case 204 is composed. Stated another way, the stator attachment system 200 enables the fixed vane stators 202 to be coupled to the compressor case 204 when the coefficients of thermal expansion of the fixed vane stators 202 and the compressor case 204 are different.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A stator attachment system for coupling a stator to a compressor case, the compressor case split to define a first half and a second half, the stator attachment system comprising:

a plurality of retention slots defined in each of the first half and the second half of the compressor case, the plurality of retention slots spaced apart about a perimeter of the first half and the second half of the compressor case such that at least one of the plurality of retention slots associated with the first half is vertically aligned with at least one of the plurality of retention slots associated with the second half; and the stator having a first stator half and a second stator half, each of the first stator half and the second stator half are integrally formed and include an outer platform, an inner platform, a plurality of tabs and a plurality of fixed stator vanes that extend between the outer platform and the inner platform, the outer platform including a front surface and an opposite back surface in a direction of fluid flow through the stator, the back surface defining a slot that receives a sealing member such that the sealing member is positioned between the back surface and a surface of the respective one of the first half and the second half of the compressor case to reduce leakage through the stator, the inner platform is integrally formed with an inner seal interface having a first leg, a second leg and a third leg, the second leg angled relative to the first leg and the third leg, the third leg defines a recess to receive a portion of a sealing structure and the inner seal interface defines an inner perimeter of the respective one of the first stator half and the second stator half, the plurality of tabs extend radially outward from the outer platform, each of the plurality of tabs configured to engage with one of the plurality of retention slots to couple the stator to the compressor case, the plurality of tabs for each of the first stator half and the second stator half includes a first tab portion at a first stator end, a second tab and a third tab portion at a second stator end, the first stator end opposite the second stator end, the first tab portion extends for a first distance, the second tab extends for a second distance, the second distance is greater than the first distance, and the second tab defines a second planar sidewall that is spaced apart from a planar sidewall of the respective one of the plurality of retention slots by a distance to provide clearance for thermal expansion of at least the stator.

2. The stator attachment system of claim 1, wherein the plurality of retention slots for each of the first half and the second half of the compressor case includes at least a first retention slot portion at a first end, a second retention slot and a third retention slot portion at a second end, the first end opposite the second end.

3. The stator attachment system of claim 2, wherein the second retention slot of each of the first half and the second half is vertically aligned.

4. The stator attachment system of claim 1, wherein the first tab portion includes a coupling bore, and the coupling bore of the first tab portion of the first stator half is configured to be coaxially aligned with the coupling bore of the first tab portion of the second stator half to receive a pin to couple the first stator half to the second stator half.

5. The stator attachment system of claim 1, wherein the plurality of retention slots extend along an axis that is parallel to a longitudinal axis of the compressor case.

6. The stator attachment system of claim 1, wherein the first tab portion defines a first planar sidewall that cooperates with a planar sidewall of the first retention slot portion to constrain a radial and axial movement of the stator relative to a longitudinal axis of the gas turbine engine.

7. A gas turbine engine comprising:

a split compressor case having a first half and a second half, each of the first half and the second half having a plurality of retention slots spaced apart about a perimeter of the respective one of the first half and the second half; and a stator split to define a first stator half and a second stator half, each of the first stator half and the second stator half are integrally formed and include an outer platform, an inner platform, a plurality of fixed stator vanes that extend between the outer platform and the inner platform, and a plurality of tabs that extend radially outward from the outer platform of the respective one of the first stator half and the second stator half, the outer platform including a front surface and an opposite back surface in a direction of fluid flow through the stator, the back surface defining a slot that receives a sealing member such that the sealing member is positioned between the back surface and a surface of the respective one of the first half and the second half of the compressor case to reduce leakage through the stator, the inner platform including an inner seal interface defining a recess to receive a portion of a sealing structure, the inner seal interface defines an inner perimeter of the respective one of the first stator half and the second stator half, the inner seal interface having a first leg, a second leg and a third leg, the second leg angled relative to the first leg and the third leg, the third leg defines a recess to receive a portion of a sealing structure, with each tab of the plurality of tabs configured to be received within a respective one of the plurality of retention slots to couple the first stator half to the first half of the compressor case and to couple the second stator half to the second half of the compressor case, the plurality of tabs for each of the first stator half and the second stator half includes a first tab portion at a first stator end, a second tab and a third tab portion at a second stator end, the first stator end opposite the second stator end, the first tab portion extends for a first distance, the second tab extends for a second distance, the second distance is greater than the first distance, the first tab portion defines a first planar sidewall that cooperates with a planar sidewall of the respective one of the plurality of retention slots to constrain a radial and axial movement of the stator relative to a longitudinal axis of the gas turbine engine, and the second tab defines a second planar sidewall that is spaced apart from another planar sidewall of the respective one of the plurality of retention slots by a distance to provide clearance for thermal expansion of at least the stator.

8. The gas turbine engine of claim 7, wherein at least one of the plurality of retention slots of the first half is vertically aligned with at least one of the plurality of retention slots of the second half.

9. The gas turbine engine of claim 7, wherein the plurality of retention slots for each of the first half and the second half of the compressor case includes at least a first retention slot portion at a first end, a second retention slot and a third retention slot portion at a second end, the first end opposite the second end.

10. The gas turbine engine of claim 7, wherein the first tab portion of the first stator half and the first tab portion of the second stator half are configured to be received within the first retention slot portion of the first half and the first retention slot portion of the second half, respectively.

11. The gas turbine engine of claim 7, wherein the first tab portion includes a coupling bore, and the coupling bore of the first tab portion of the first stator half is configured to be coaxially aligned with the coupling bore of the first tab portion of the second stator half to receive a pin to couple the first stator half to the second stator half.

12. The gas turbine engine of claim 7, wherein the stator is coupled to the split compressor case via the plurality of tabs and the plurality of retention slots such that additional mechanical fasteners are not required.

13. A gas turbine engine comprising:

a split compressor case having a first half and a second half, each of the first half and the second half having a plurality of retention slots spaced apart about a perimeter of the respective one of the first half and the second half, the plurality of retention slots includes at least a first retention slot portion at a first end, a second retention slot and a third retention slot portion at a second end, the first end opposite the second end; and a stator having a plurality of fixed stator vanes, the stator split to define a first stator half and a second stator half, each of the first stator half and the second stator half are integrally formed and include an outer platform, an inner platform, a plurality of fixed stator vanes that extend between the outer platform and the inner platform and a plurality of tabs that extend radially outward from the outer platform of the respective one of the first stator half and the second stator half, the outer platform including a front surface and an opposite back surface in a direction of fluid flow through the stator, the back surface defining a slot that receives a sealing member such that the sealing member is positioned between the back surface and a surface of the respective one of the first half and the second half of the compressor case to reduce leakage through the stator, the inner platform including an inner seal interface having a first leg, a second leg and a third leg, the second leg angled relative to the first leg and the third leg, the third leg defining a recess to receive a portion of a sealing structure and the inner seal interface defines an inner perimeter of the respective one of the first stator half and the second stator half, with each tab of the plurality of tabs configured to be received within a respective one of the plurality of retention slots to couple the first stator half to the first half of the compressor case and to couple the second stator half to the second half of the compressor case, the plurality of tabs for each of the first stator half and the second stator half includes a first tab portion at a first stator end, a second tab and a third tab portion at a second stator end, the first stator end opposite the second stator end, the first tab portion extends for a first distance, the second tab extends for a second distance, the second distance is greater than the first distance, and the second tab defines a second planar sidewall that is spaced apart from a planar sidewall of the respective one of the plurality of retention slots by a distance to provide clearance for thermal expansion of at least the stator.

14. The gas turbine engine of claim 13, wherein the first tab portion of the first stator half and the first tab portion of the second stator half are configured to be received within the first retention slot portion of the first half and the first retention slot portion of the second half, respectively, and the first tab portion defines a first planar sidewall that cooperates with a planar sidewall of the first retention slot portion to constrain a radial and axial movement of the stator relative to a longitudinal axis of the gas turbine engine.

15. The gas turbine engine of claim 14, wherein the first tab portion includes a coupling bore, the coupling bore of the first tab portion of the first stator half is configured to be coaxially aligned with the coupling bore of the first tab portion of the second stator half to receive a pin to couple the first stator half to the second stator half, and the third tab portion includes a second coupling bore, and the second coupling bore of the third tab portion of the first stator half is configured to be coaxially aligned with the second coupling bore of the third tab portion of the second stator half to receive a second pin to couple the first stator half to the second stator half.

* * * * *